US005749797A

United States Patent [19]

Sunseri et al.

[11] Patent Number: 5,749,797

[45] Date of Patent: May 12, 1998

[54] AUTOMATIC PITCHING DEVICE AND METHODS OF CONSTRUCTING AND UTILIZING SAME

[76] Inventors: Robert Sunseri, 165 S. Opdyke Rd., Lot 6, Auburn Hills, Mich. 48326; Earl Sunseri, 2233 London Bridge Dr., Unit J40, Rochester Hills, Mich. 48307

[21] Appl. No.: 609,850

[22] Filed: Mar. 1, 1996

[51] Int. Cl.[6] ..... A63B 7/00

[52] U.S. Cl. ..... 473/451; 124/16; 124/51.1

[58] Field of Search ..... 273/26 D, 29 A, 273/30, 129 S, 129 R, 129 T; 124/65, 66, 67, 68, 7, 16, 31, 17, 83; 473/132, 133, 134, 135, 136, 140

[56] References Cited

U.S. PATENT DOCUMENTS

| | | | |
|---|---|---|---|
| 1,217,553 | 2/1917 | Beatty | 124/65 |
| 1,777,976 | 10/1930 | Lacoste | 273/29 A |
| 1,897,317 | 2/1933 | McEachern | 273/26 D |
| 3,606,987 | 9/1971 | Nomura | 273/30 |
| 4,524,749 | 6/1985 | Giovagnoli . | |
| 4,978,124 | 12/1990 | Brown | 273/129 S |
| 4,995,371 | 2/1991 | Kuizinas . | |
| 5,121,735 | 6/1992 | Hancock . | |

*Primary Examiner*—Theatrice Brown

*Attorney, Agent, or Firm*—Weiner, Carrier, Burt & Esser, P.C.; Joseph P. Carrier; William F. Esser

[57] ABSTRACT

A ball or object ejecting device is disclosed which is useful as an automatic pitching machine. The device includes a support guide for supporting a ball to be ejected, a flexible impacting member for impacting against a supported ball at a large velocity for thereby forcibly ejecting the ball from the support guide, an actuating mechanism for cyclically actuating the impacting member in a predetermined cycle period, a mechanism for supplying a plurality of balls, one at a time, to the support means in the predetermined cycle period, and the actuating means also actuates the ball supplying mechanism simultaneously as it actuates the impacting member.

15 Claims, 4 Drawing Sheets

AUTOMATIC PITCHING DEVICE AND METHODS OF CONSTRUCTING AND UTILIZING SAME

BACKGROUND OF THE INVENTION

1. Field of the Invention

The present invention pertains to an automatic pitching machine for use in batting or hitting practice, and to methods of constructing and utilizing same. More particularly, the present invention pertains to a portable, highly compact, automatic pitching machine for pitching a series of balls or other objects at relatively high speed using a simplified ejecting mechanism, such that a person may practice hitting the eject balls.

2. Description of the Relevant Art

There are many known automatic pitching devices. For example, U.S. Pat. Nos. 4,524,749, 4,834,060, 4,995,371, and 5,121,735 disclose types of automatic pitching device in which a series of balls are forcibly ejected by the device such that a person may practice batting the ejected balls. Although all of such known pitching devices function in a generally satisfactory manner, they each have disadvantages and limitations associated therewith, whereby they are excessively cumbersome and expensive, while subject to breakage, insufficiently challenging, etc. For example, each of the devices disclosed in U.S. Pat. Nos. 4,524,749 and 5,121,735 discloses a relatively large unit which may be wheeled about from location to location, including a spring-biased pitching arm which selectively receives individual balls on a free end thereof, is rotated through a large angle (such as 360°) by relatively complex mechanism of gears, pulleys, belts, chains for tensioning the spring arm, and an inclined chute mechanism for individually delivering balls to a free end of the spring arm in a predetermined position thereof Due to the relatively large size, complexity and associated cost thereof, such devices may not be practically suitable for most individuals, and are otherwise subject to breakage and reliability problems.

The device disclosed in the U.S. Pat. No. 4,834,060 is a relatively compact, battery powered pitching apparatus which includes a counter-rotating motors for rotating a pair of wheels which eject balls that are moved therebetween, an indexing mechanism with its own gear motor which delivers balls one at a time from a collapsible hopper to the rotatable wheels, and another gear motor and associated mechanism for tilting the device relative to a support stand for thereby varying a vertical trajectory of thrown balls, and a battery for powering the several motors. Although this device is smaller and less expensive than the devices discussed above involving the rotating spring arms, the multiple motor construction thereof still renders relatively expensive and susceptible to breakdowns.

The device disclosed in U.S. Pat. No. 4,995,371 includes a frame, a pivoting, ball-ejecting arm having a ball receiver on one thereof and an opposite end pivotally connected to the frame, a cam-type driving mechanism for periodically driving the ejecting arm to a horizontal position thereof, a pair of springs connected to the ejecting arm for normally urging the arm toward a vertical position thereof, and an inclined tube with a spring loaded cover on a lower end thereof for delivering balls, one at a time, into the receiver on the end of the ejecting arm when it is disposed in its horizontal position. While this noted device is relatively simple in a structure, its open construction renders less challenging to hitters, the ball delivery tube is limited in size, and hence having a number of balls that can be successively delivered, etc.

The present invention has been developed to overcome the disadvantages and limitations of known automatic pitching devices, including those discussed above, and to generally fulfill a need in the art for an automatic pitching device which is highly compact, light weight and portable, fully automated yet inexpensive to produce and affordable for most individuals, capable of delivering a large number of balls in succession at high speeds, adjustable, and challenging for novice as well as pro.

SUMMARY OF THE INVENTION

According to the invention there is provided an object ejecting device, comprising: support means for supporting an object to be ejected; impacting means for impacting against said object for forcibly ejecting said object from said support means; and actuating means for cyclicly actuating said impacting means in a predetermined cyclical period.

Preferably, the impacting means will impact against the object with a relatively large velocity so that the object will correspondingly be ejected as a relatively large velocity; the object ejecting device will further include means for supplying a plurality of the objects, one at a time, to the support means, and the actuating means will also simultaneously actuate the supplying means in said predetermined cyclical period.

Also preferably, the object ejecting device will additionally include a power supply such as a battery and a housing which maintains the several components of the device in relative positions to each other, the housing having an opening through which the balls are ejected, and the support means is disposed adjacent to the opening.

Most preferably, the impacting means comprises a flexible arm normally disposed adjacent to the supporting means, the actuating means comprises a rigid member moveable in a substantially linear fashion including a first projecting portion engageable with the flexible arm for flexing the arm, and a second projecting portion engageable with the ball supplying means for actuating same.

The above object ejecting device according to the invention is very desirable and advantageous because it has a desirably simple structure, noting that the flexible arm may be constructed as a length of spring steel and that a single actuating mechanism actuates both the flexible arm such that it impacts against a supported ball at relatively high velocity and also actuates the ball supplying means. Such simplicity leads to reduction in cost, and a reduction in size, and improved reliability because there are less parts to install, maintain or fix.

It is an object of the invention to provide an automatic pitching device which is compact, light weight and portable, and can pitch balls or other objects with a relatively high velocity in such a fashion that most persons will be significantly challenged when attempting to hit the objects that are pitched by the device.

It is another object of the invention to provide such a ball pitching device which includes a large supply of balls which can be automatically pitched in succession one after the other by the device, and which efficiently utilizes a single actuating means for causing the balls to be pitched or ejected from the device and for causing a single ball from the large supply of balls to be delivered to position from which it will be pitched or ejected by the device.

It is yet another object of the invention to provide such a ball pitching device which includes its own power supply and an adjustable base such that it may be used substantially anywhere.

It is still another object of the invention to provide such a ball pitching device which is constructed of rigid, durable components such that it may be reliably used for a long period of time, and yet is relatively simple and economic to manufacture.

Other objects, advantages and salient features of the invention will be apparent from the following detailed description, which, when taken in conjunction with the annexed drawings, discloses a preferred embodiment of the invention.

DETAILED DESCRIPTION OF THE PREFERRED EMBODIMENT

Figure 1:
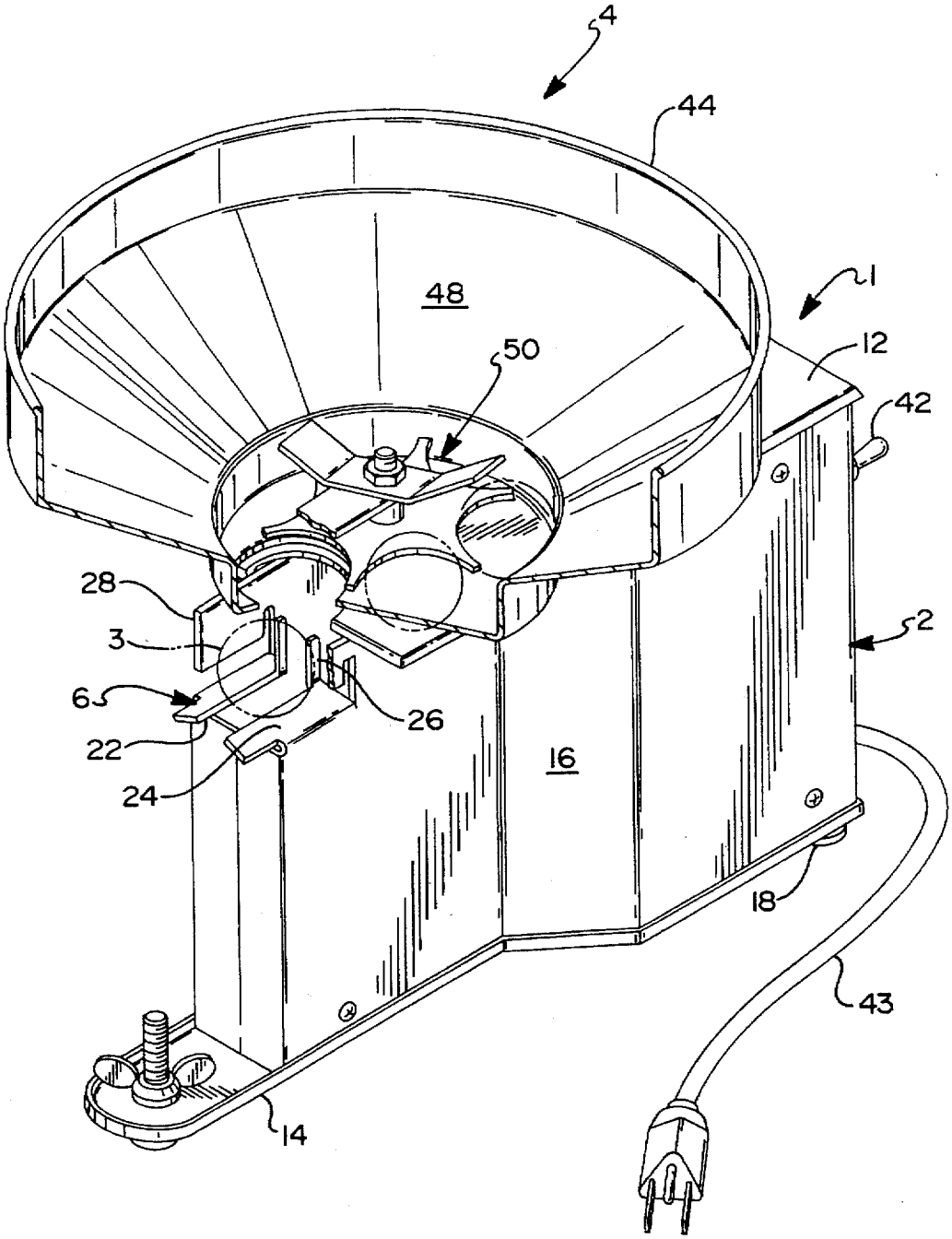
FIG. 1 is a perspective view of a preferred embodiment of the invention, with part of an upper ball supplying portion of the device broken away to reveal internal structure thereof.

Referring to FIGS. 1–4, there is shown the preferred embodiment of the ball or object pitching device according to the invention. The pitching device 1 generally includes a housing 2, supply means 4 for supplying a plurality of balls to be pitched, one at a time, by the device, a support means or guide 6 for supporting an individual ball in a position to be pitched by the device, an impacting means 8 for impacting against the ball as supported by the support means 6 at a relatively high velocity for thereby pitching the ball from the device at a corresponding high velocity, and actuating means for actuating both the impacting means 8 and the ball supplying means 4 in a predetermined cyclical period.

The housing 2 is a substantially enclosed receptacle with an upper lid 12, a base 14 and side wall 16, all of which it may be constructed of suitable materials such as sheet metal, molded plastic, etc. and are joined together using appropriate fastening means such as adhesive, screws, rivets, etc. The base 14 of the housing is preferably a substantially flat or planar member as depicted, and preferably includes a plurality of supporting feet 18, 20 extending downwardly therefrom for supporting the device on the ground, on a table, etc. Particularly, the base preferably includes a pair of a support feet 18 at a rear end thereof and a single support foot 20 and a front end thereof. All of the supports 18, 20 are preferably adjustable so that the base 14 may be adjusted for being supported on different surfaces, but the front support foot 20 is particularly, easily adjustable for adjusting an angular orientation of a front end of the base relative to the support surface.

The ball support means or guide 6 is preferably formed integrally with the sidewall 16 of the housing as depicted for purposes of simplicity and economy of manufacture, and with such construction, the angular orientation of the ball support guide 6 relative to a surface on which the device is supported may be easily changed with adjustment of the front support foot 20. As depicted, the ball support guide 6 preferably includes a pair of symmetrical halves with an open channel 22 defined therebetween. Each of the halves includes a lower portion 24 and a rear portion 26 which extends perpendicularly from the lower portion. The lower portion is inclined rearwardly downward regardless of the adjusted orientation of the base 14 such that a ball 3 as supported by the support guide 6 normally rests against the rear portions 26 of the guide. The housing sidewall 16 preferably includes front projecting portions 28 which extend at the sides of the guide 6 for assuring that a ball 3 which is dropped onto the guide 6 from the ball supply means 4 (as discussed further hereinbelow) will not roll sideways off the guide 6, and for partially shielding the ball 3 as supported on the guide 6 from view by a batter to thereby make hitting of the ball more challenging. The lower portions 24 of the guide 6 project in front of the sidewall 16 of the housing for preventing the balls 3 as dropped onto the guide from rolling forwardly off the guide, and for providing a sufficiently long launch path for the balls.

The upper or cover member 12 of the housing 2 preferably has a plurality of mounting bosses 30 provided at a front portion thereof for having the ball supplying means 4 mounted thereto with a space therebetween for accommodating a gear portion of the ball supplying means 4 and a portion of the actuating means 10 as discussed further below. The cover also includes a pair of openings 32, 34 formed therein, and a shaft 40 of the ball supplying means 4 is secured to the cover 12 with a bolt 38 or other appropriate fastening means. As depicted, the opening 32 is preferably provided at a front edge of the cover 12 for permitting balls 3 from a ball supplying means 4 to be dropped therethrough onto the guide 6. The opening 34 is provided at an intermediate portion of the cover 12 and is sufficiently long to permit a gear engagement portion 70 of the actuating means 10 to extend therethrough for a full stroke of the actuating means as discussed hereinbelow.

An actuation switch 42 of the actuating means 10 is preferably disposed on a portion of the housing 2 as depicted for easy access and a power supply cord 43 also extends from the housing for being connected to a AC power supply or the like.

The ball supplying means 4, as depicted, preferably includes the large receptacle or hopper 44 for holding a large quantity of balls 3 and an indexing means or mechanism 50 which individually moves the balls 3 from the receptacle 44 to the ball support guide 6.

A lower surface of the receptacle 44 is preferably connected to the cover 12 of the housing 2 at the projecting bosses 30 as discussed above using screws or other appropriate fastening means, and the indexing means 50 is preferably, centrally disposed within a lower portion 46 of the receptacle 44. The upper end of the receptacle 44 is preferably open as depicted, so that balls 3 supported in the receptacle may extend above the receptacle's upper end, and a sidewall 48 of the receptacle is preferably tapered inwardly downward so that the balls supported therein will naturally all move downwardly toward the indexing means 50 under the pull of gravity.

Figure 2:
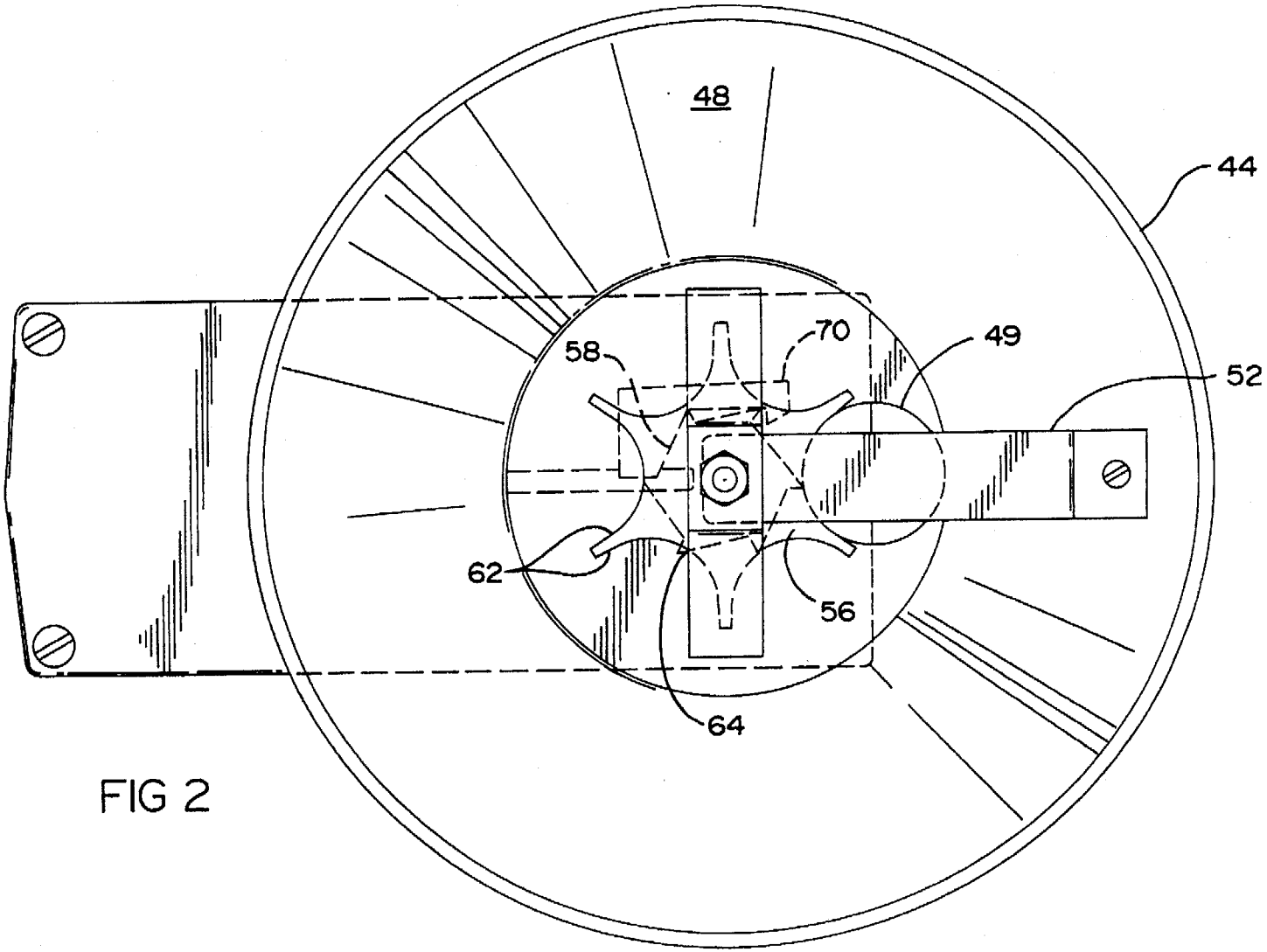
FIG. 2 is a top plan view of the device of FIG. 1, with some internal structure of the ball supplying portion of the device shown in broken lines to reveal the structure thereof.

The indexing means 50 includes the shaft 40 which extends perpendicularly from the bottom surface of the receptacle 44 and has its lower end fixed to the cover 12 of the housing 2 with the bolt 38. An upper end of the bolt 38 is supported relative to the receptacle 44 through a support bracket 52 having one end fixed to the sloping sidewall 48 of the receptacle 44 and an opposite end secured to an upper end of the bolt 38 using a nut 54 or other appropriate fixing means. The indexing means 50 also includes a ball advancing star wheel 56 which is integrally formed with the shaft 40 so that it turns with the shaft, a gear 58 fixed to a lower end of the bolt 38, and a bent spacer arm 60 connected near the upper end of the bolt 38 above the bracket member 52. The star wheel 56 has a number of concave recesses 62 defined in the outer peripheral edge thereof, and each of which is shaped to engage the outer surface of a ball 3 as best shown in FIG. 2. Balls 3 in the receptacle 44 will drop down into the lower portion 46 of the receptacle between the surfaces thereof and the recesses 62 of the star wheel 56. As the star wheel is rotated, it engages the balls in the recesses 62 thereof so as to roll them until they come to an opening 49 in the bottom surface of the receptacle which is disposed directly above the front opening 32 in the upper cover 12 of the housing 2 so that a ball 3 which has been moved into position by the star wheel over the opening 49 drop through the openings 49, 32 onto the ball supporting guide 6. The support bracket 52 and the bent arm member 60 function to prevent jamming of the star wheel 56 by maintaining some clearance between the balls 3 which are disposed in the lower portion 46 of the receptacle 44 (so as to be rotated by the star wheel 56) and all of the remaining balls disposed thereabove in the receptacle 44.

The gear 58 is fixed to the lower end of the bolt 38 and disposed within the spaces between the bottom surface of the receptacle 44 and the upper surface of the housing cover 12 as discussed above. The gear 58 has a plurality of teeth 64 (as best shown in FIG. 2) corresponding to the number of recesses 62 in the star wheel 56, and which are shaped to be engaged by the member 70 of the actuating means such that the gear 58 (and hence the shaft 40 and star wheel 56 connected thereto) will be rotated counter-clockwise a distance corresponding to one of the recesses 62 with a rearward stroke of the member 70 so as to move a ball 3 from a position adjacent the opening 49 to position directly over the opening 49 where it will fall therethrough.

Figure 3:
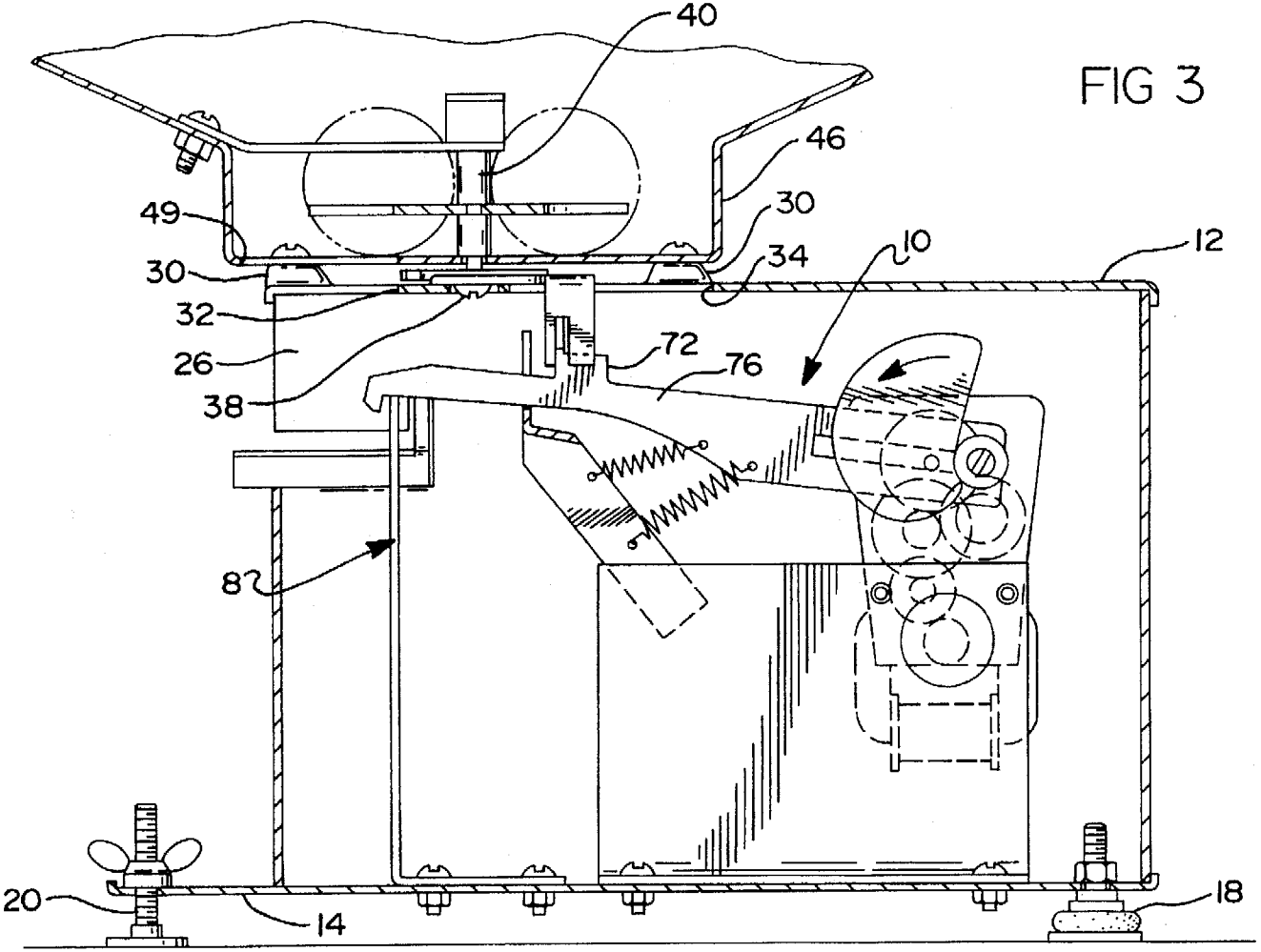
FIG. 3 is a side elevational view of the device of FIG. 1, the device being shown in cross section to reveal internal structure thereof, with an actuating portion of the device in a normal or forward position thereof, and in which part of the upper receptacle portion of the device is omitted.
Figure 4:
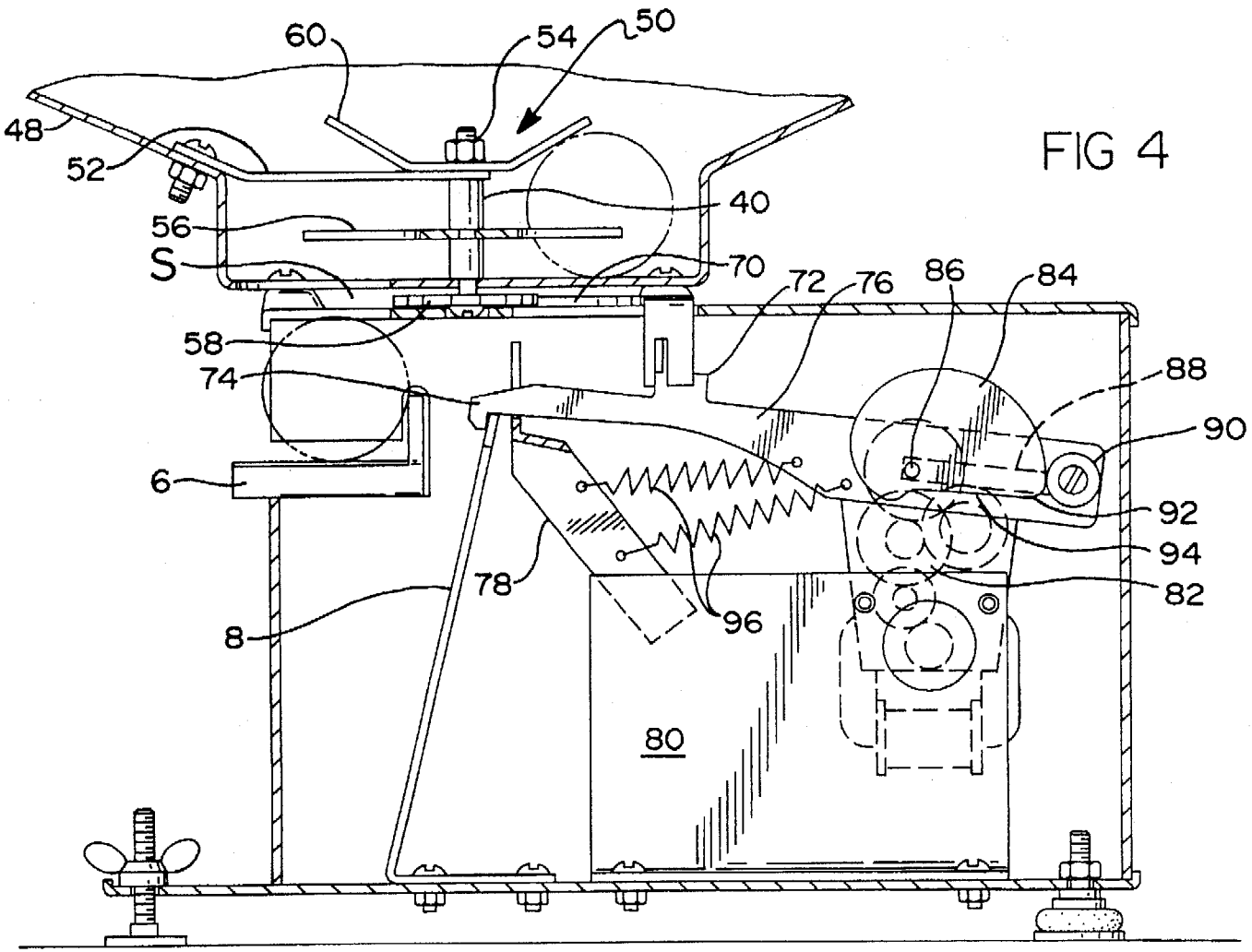
FIG. 4 is substantially identical to FIG. 3, but in which the actuating member is in a tensioned, rear position thereof.

The impacting means 8 preferably comprises a strip of spring steel or a leaf spring, formed into an L-shape with the short leg thereof fixed to the base 14 of the housing with screws or other appropriate fastening means, as shown in FIGS. 3 and 4. In its normal or unflexed position, the free end of the leaf spring will extend into the opening 22 between the halves of the balls supporting guide 6 as shown in FIG. 3. During a ball pitching operation of the device, a free end of the leaf spring is drawn rearwardly by a projecting end 74 of a rigid actuating member 76 of the actuating means 10 as shown in FIG. 4, and at the end of the rearward stroke of the member 76 it is lifted slightly (as discussed further hereinbelow) to release the leaf spring, whereupon the leaf spring springs rapidly back to its normal position between the halves of the ball supporting guide 6 and there impacts against a ball 3 supported on the guide so that the ball is pitched or ejected from the device at a relatively high speed corresponding to the spring back speed of the flexed spring.

The actuating means 10 preferably includes the rigid actuating member 76, a guide bracket 78, a motor 80, a gear mechanism 82 connected to an output shaft of the motor 80 for reducing a speed thereof, a cam 84 connected to the gear mechanism 82 by a shaft 86 extending through an elongate slot 88 formed in a rear portion of the rigid actuating member 76, and a cam roller 90 fixed to a rear end of the rigid actuating member 76 and engaged with the cam 84. Upon actuation of the motor, such as by plugging in the cord 43 and/or moving the switch 42 to its on position, the cam 84 is rotated counter-clockwise as viewed in FIGS. 3 and 4 by the gear mechanism 82, and upon rotation of the cam 84 the rigid actuating member 76 is cyclically moved rearwardly and forwardly in a substantially linear manner due to engagement of the cam 84 with the cam roller 90 and the shaft 86 with the slot 88. More particularly, with the rigid actuating member 76 in its forward most position as shown in FIG. 3, it is drawn substantially linearly rearwardly as the cam roller 90 is pushed rearwardly to its engagement with the cam 84 until the actuating member 76 is in its rear most position as shown in FIG. 4, after which continued rotation of the cam 84 causes the roller 90 to move around a substantially 90° corner 92 of the cam causing the rigid actuating arm 76 to be pivoted slightly about the roller 90 thereby lifting the forward projecting end 74 of the member from engagement with the impacting leaf spring 8 so that it flexes back to impact against the ball 3 supported on the supporting guide 6. Upon still further rotation of the cam, the roller 90 engages a substantially flat edge 94 of the cam, the actuating member 76 is sprung forwardly to the position shown in FIG. 3 under the biasing force of springs 96 connected between the actuating member 76 and the guide member 78, whereupon the actuating cycle would again be repeated upon further rotation of the cam 84.

According to an important aspect of the invention, the substantially linear movement of the rigid actuating member 76 not only actuates the impacting leaf spring 8, but also simultaneously actuates the indexing means 50. Particularly, when the actuating member 76 is in its forward most position as shown in FIG. 3, a second or upper projecting portion 72 thereof having the gear engagement member 70 fixed thereto is positioned such that a forward end of the gear engaging member 70 engages with one of the teeth 64 of the gear 58 as best shown in FIGS. 2 and 3; and upon rearward movement of the rigid actuating member 76, the gear engaging member 70 rotates the gear counter-clockwise (in FIG. 2) a distance corresponding to the span of one of the concave recesses 62 of the star wheel 56 such that a ball 3 is moved over the openings 49, 32 and drops therethrough onto the ball supporting guide 6 during an initial portion of the rearward stroke of the actuating member 76 so that the ball will settle onto the guide 6 and be ready to impacted by the leaf spring 8 when it is released by the actuating member 76 at the rear end of its stroke.

It is preferred that the balls 3 or other objects pitched by the device will be of light weight construction such as hollow ping pong balls, spongy foam balls, etc. Light weight objects can be discharged at a relatively high velocity by the flexed leaf spring impacting member according to the invention without making the overall device excessively large or weighty. Even though the objects may be small and lightweight, when they are discharged with high velocity according to the invention they will still be quite challenging to hit in any event, while the use of the light weight objects permits the device to be used indoors as well as outdoors. Further, if objects to be discharged are hollow such as ping pong balls, the balls can be easily adjusted for varying how the balls travel after being impacted by the leaf spring 8. Particularly, by simply forming one or more dents on a surface of the ball, the ball will curve, drop, or make other unpredictable motions after being impacted by the leaf spring 8 making use of the device even more challenging for a hitter.

Although there has been described what is at present considered to be the preferred embodiment of the invention, it will be understood that various modifications and changes can be made thereto without departing from the spirit and scope of the invention. For example, although the ball supporting guide 6 is preferably formed as a rigid, fixed member together with the housing sidewall 16, it is possible to make the ball supporting guide 6 as an adjustable member such that its angular orientation relative to the housing sidewall 16 may be selectively adjusted. Further, although the motor 10 is depicted as being connectible to a power supply through the electrical cord, the device may additionally and/or alternatively include its own power supply such as rechargeable battery. Even with the addition of a rechargeable battery, the overall device will still be relatively light weight and easily portable.

Additionally, the device could include other components for ease of use and convenience, including a cover for the receptacle 44, a handle connected to the housing 2, an automatic cut-off switch for turning off the motor 10 in the event that the indexing means 50 should become jammed, etc.

Additionally, although the device is preferably adapted for ejecting spherical objects such as the balls 3, it could be readily modified for ejecting other objects such as hollow pucks if the object supporting guide 6 were modified to be in the form of a chute, etc.

Relatedly, if the device is used to discharge ping pong balls for practicing hitting the balls on a ping pong table or the like, the ball supporting means would have to be adjusted such that the balls are discharged downwardly rather than with an upward trajectory.

The scope of the invention is indicated by the appended claims, rather than by the foregoing description.

We claim:

1. An object ejecting device comprising:

support means for supporting an object to be ejected;

impacting means for impacting against said object at a relatively large velocity for forcibly ejecting said object from said support means;

means for supplying a plurality of said objects, one at a time, to said support means in a predetermined cyclical period;

actuating means for cyclically actuating both said impacting means and said supplying means in said predetermined cyclical period;

said actuating means comprising a rigid member movable in a substantially linear fashion, said rigid member having a first projecting portion engageable and disengageable with said impacting means for actuating said impacting means, and a second projecting portion engageable with said supplying means for actuating said supplying means; and wherein said actuating means further comprises a motorized mechanism operatively connected to said rigid member for moving said rigid member in said substantially linear fashion.

2. An object ejecting device according to claim 1, further including:

a housing for said support means, said impacting means, said actuating means, and said supplying means, said housing having an opening defined therein for having said objects ejected therethrough, and said support means being disposed adjacent to said opening.

3. An object ejecting device according to claim 2, wherein said housing is adjustable for being supported on different surfaces and for varying a trajectory of ejected objects.

4. An object device according to claim 1, wherein said motorized mechanism comprises a motorized, rotating cam mechanism operatively connected to said rigid member for moving said rigid member in said substantially linear fashion.

5. An object ejecting device according to claim 4, wherein said actuating means further includes biasing means for biasing said rigid member to a position where said first projecting portion is adjacent to said support means, and said rotating cam mechanism moves said rigid member away from said support means.

6. An object ejecting device according to claim 1, wherein said impacting means comprises a flexible spring arm having one fixed end and an opposite free end, and said actuating means cyclically flexes said free end of said flexible spring arm away from said support means and releases the flexed free end of the flexible spring arm such that it springs back toward the support means to impact the object supported by the support means.

7. An object ejecting device according to claim 1, wherein said support means is adjustable for carrying a trajectory of ejected objects.

8. An object ejecting device according to claim 1, wherein:

said supplying means includes a receptacle for storing a plurality of objects therein and a rotatable indexing means disposed between said receptacle and said support means for individually moving said objects from said receptacle to said support means, said actuating means simultaneously actuates said supply means and said impacting means.

9. An object ejecting device according to claim 8, wherein said rigid member actuates both the supplying means and the impacting means while moving in one linear direction.

10. An object ejecting device, comprising:

discharge means for discharging an object from the device;

means for supplying a plurality of said objects, one at a time, to said discharge means at a predetermined cyclical period;

actuating means for simultaneously actuating said supplying means and said discharge means in said predetermined cyclical period;

said actuating mean comprising a rigid member movable in a substantially linear fashion, said rigid member having a first projecting portion engageable and disengageable with said discharge means for actuating said discharge means, and a second projecting portion engageable with said supplying means for actuating said supplying means; and wherein said actuating means further comprises a motorized, rotatable cam mechanism operatively connected to said rigid member for moving said rigid member in said substantially linear fashion.

11. An object ejecting device, comprising:

discharge means for discharging an object from the device;

means for supplying a plurality of said objects, one at a time, to said discharge means at a predetermined cyclical period;

actuating means for simultaneously actuating said supplying means and said discharge means in said predetermined cyclical period;

said actuating means comprising a rigid member movable in a substantially linear fashion, said rigid member having a first projecting portion engageable and disengageable with said discharge means for actuating said discharge means, and a second projecting portion engageable with said supplying means for actuating said supplying means; and wherein said supply means includes a receptacle for storing a plurality of objects therein and a rotatable indexing means disposed between said receptacle and said discharging means for simultaneously moving a plurality of said objects from said receptacle such that the objects are delivered individually to said discharge means.

12. An object ejecting device, comprising:

discharge means for discharging an object from the device;

means for supplying a plurality of said objects one at a time, to said discharge means at a predetermined cyclical period;

actuating means for simultaneously actuating said supplying means and said discharge means in said predetermined cyclical period;

said actuating means comprising a rigid member movable in a substantially linear fashion, said rigid member having a first projecting portion engageable and disengageable with said discharge means for actuating said discharge means, and a second projecting portion engageable with said supplying means for actuating said supplying means; and wherein said discharge means comprises an object supporting guide for supporting an object in a position to be discharged, and a flexible spring member for impacting an object as supported on said guide at a relatively high velocity, said supporting guide is adjustable to selectively vary a trajectory of the discharged object.

13. An object ejecting device, comprising:

discharge means for discharging an object from the device;

means for supplying a plurality of said objects, one at a time, to said discharge means at a predetermined cyclical period;

actuating means for simultaneously actuating said supplying means and said discharge means in said predetermined cyclical period;

said actuating means comprising a rigid member movable in a substantially linear fashion including a first projecting portion engageable and disengageable with said discharge means for actuating said discharge means, and a second projecting portion engageable with said supplying means for actuating said supplying means; and wherein said discharge means comprises a flexible spring member for impacting against said object at a relatively large velocity for forcibly ejecting said object from the device, said flexible spring member having one fixed end and an opposite free end which impacts against said object, and said first projecting portion of said rigid member is selectively engageable with the free end of said flexible spring member for flexing the free end.

14. An object ejecting device comprising:

a support guide for supporting an object to be ejected;

a flexible spring member for impacting against the object at a relatively large velocity for forcibly ejecting the object from said support guide;

actuating means for cyclically flexing and releasing said flexible spring member in a predetermined cyclical period;

a receptacle for supporting a plurality of objects relative to the support guide;

a rotatable indexing mechanism for supplying said plurality of objects from said receptacle, one at a time, to said support guide in said predetermined cyclical period;

a housing for said support guide, said flexible spring member, and said actuating means, said housing having an opening defined therein for having said objects ejected therethrough; and said actuating means comprising a rigid member movable in a substantially linear manner, said rigid member having a first projecting portion engageable with said flexible spring member for flexing the spring member, and a second projecting portion engageable with said indexing means for actuating said indexing means.

15. An object ejecting device according to claim 14, wherein said actuating means further includes a rotatable cam mechanism operatively connected to said rigid member for moving said rigid member in said substantially linear manner.

* * * * *